US008922609B2

(12) United States Patent
Iguchi et al.

(10) Patent No.: US 8,922,609 B2
(45) **Date of Patent: *Dec. 30, 2014**

(54) METHOD FOR COLOR ERASING PROCESS AND COLOR ERASING DEVICE

(71) Applicants: Kabushiki Kaisha Toshiba, Tokyo (JP); Toshiba Tec Kabushiki Kaisha, Tokyo (JP)

(72) Inventors: Ken Iguchi, Shizuoka-ken (JP); Isao Yahata, Shizuoka-ken (JP); Takahiro Kawaguchi, Shizuoka-ken (JP); Yoshiaki Sugizaki, Shizuoka-ken (JP); Kikuo Mizutani, Shizuoka-ken (JP); Hiroyuki Taki, Shizuoka (JP); Hiroyuki Tsuchihashi, Shizuoka-ken (JP); Chiaki Iizuka, Shizuoka-ken (JP); Hidetoshi Yokochi, Shizuoka-ken (JP); Toshiaki Oshiro, Shizuoka-ken (JP); Hiroyuki Hazu, Shizuoka-ken (JP); Yoichi Yamaguchi, Shizuoka-ken (JP); Hiroyuki Sugiyama, Shizuoka-ken (JP); Yuichi Saito, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/972,677

(22) Filed: Aug. 21, 2013

(65) Prior Publication Data

US 2014/0045685 A1 Feb. 13, 2014

Related U.S. Application Data

(62) Division of application No. 13/534,994, filed on Jun. 27, 2012, now Pat. No. 8,542,261.

(60) Provisional application No. 61/508,489, filed on Jul. 15, 2011, provisional application No. 61/503,575, filed on Jun. 30, 2011, provisional application No. 61/503,576, filed on Jun. 30, 2011.

(51) Int. Cl.

| | |
|---|---|
| ***B41J 2/32*** | (2006.01) |
| ***B41M 5/28*** | (2006.01) |
| *B41M 7/00* | (2006.01) |

(52) U.S. Cl.

CPC ..... *B41M 5/282* (2013.01); *B41M 7/009* (2013.01); *B41M 7/0009* (2013.01); *B41J 2/32* (2013.01); *B41J 2202/37* (2013.01)

USPC ..... 347/179

(58) Field of Classification Search

USPC ..... 347/171, 179

See application file for complete search history.

(56) References Cited

U.S. PATENT DOCUMENTS

| | | | |
|---|---|---|---|
| 7,206,009 | B2 | 4/2007 | Taniguchi |
| 8,284,221 | B2 | 10/2012 | Taguchi |

(Continued)

FOREIGN PATENT DOCUMENTS

| | | |
|---|---|---|
| EP | 1260375 | 11/2002 |

(Continued)

*Primary Examiner* — Huan Tran

(74) *Attorney, Agent, or Firm* — Patterson & Sheridan LLP

(57) ABSTRACT

According to an embodiment, a method for color erasing process includes the steps of: supplying a power to a heat source configured to heat a sheet having an image formed thereon using a color erasable material so as to cause heat generation as warming-up control; stopping the power supply to the heat source for a predetermined period of time in the warming-up control if the temperature of the heat source is increased starting from a temperature lower than a predetermined reference value that is lower than a color erasing temperature of the color erasable material and exceeds the predetermined reference value; performing maintenance control that is power supply control to maintain the temperature of the heat source at the target temperature; and performing, after the passage of the predetermined period of time, a color erasing process by the heat source.

20 Claims, 7 Drawing Sheets

(56) References Cited

U.S. PATENT DOCUMENTS

| | | | | |
|---|---|---|---|---|
| 8,289,353 | B2 | 10/2012 | Taguchi et al. | |
| 8,542,261 | B2 * | 9/2013 | Iguchi et al. | 347/179 |
| 2012/0306985 | A1 | 12/2012 | Iguchi et al. | |
| 2013/0022782 | A1 | 1/2013 | Babej et al. | |
| 2013/0022783 | A1 | 1/2013 | Zagorski et al. | |

FOREIGN PATENT DOCUMENTS

| | | |
|---|---|---|
| JP | 06-047990 | 2/1994 |
| JP | 2001-334692 | 12/2001 |
| JP | 2008006687 | 1/2008 |
| JP | 2011148319 | 8/2011 |
| WO | 2006011373 | 2/2006 |

* cited by examiner

METHOD FOR COLOR ERASING PROCESS AND COLOR ERASING DEVICE

CROSS-REFERENCE TO RELATED APPLICATIONS

This application is based upon and claims the benefit of priority from U.S. application Ser. No. 13/534,994, filed on Jun. 27, 2012; which claims the benefit of priority from U.S. provisional application 61/508,489, filed on Jul. 15, 2011; U.S. provisional application 61/503,575, filed on Jun. 30, 2011; and U.S. provisional application 61/503,576, filed on Jun. 30, 2011; the entire contents of which are each incorporated herein by reference.

TECHNICAL FIELD

Embodiments described herein relate generally to a color erasing device and a color erasing method for erasing color of an image formed on a sheet with a color erasable material to be color erased by heat.

BACKGROUND

Conventionally, an image has been formed on a sheet of paper using a color erasable material such as a color erasable toner in which color is to be erased by heat. There has been proposed a color erasing device which erases an image by applying heat to a sheet of paper on which the image has been formed with a color erasable material so as to erase color of the color erasable material on the sheet of paper. The color erasing process performed by the color erasing device makes it possible to form an image again on the sheet of paper, thereby allowing the reuse of the sheet of paper.

A color erasing section for heating and erasing color of a color erasable material is formed by a heat source such as a heater, a temperature sensor for detecting a temperature of the heat source, and the like. Based on the temperature of the heat source detected by the temperature sensor, the temperature of the heat source is controlled and the color erasing process is performed.

However, there is a case where the temperature sensor fails to follow the actual temperature change in the heat source and appropriate control for the heat source therefore cannot be performed. For example, due to such insufficient following, the temperature of the heat source may be increased too high and a resin component in the color erasable toner may be thus melted and attached to the color erasing section.

DETAILED DESCRIPTION

According to an embodiment, a color erasing device (a decolorizing device) includes a heat source, a temperature detecting section, a heat source controller, and a sheet feeding section. The heat source heats a sheet having an image formed thereon using a color erasable material (a decolorable colorant) to be color erased by heat. The temperature detecting section detects a temperature of the heat source. The heat source controller supplies a power to the heat source as warming-up control to raise the temperature of the heat source to a target temperature set as a temperature used during a color erasing process (a decolorizing process), stops the power supply to the heat source for a predetermined period of time in the warming-up control if the temperature of the heat source detected by the temperature detecting section is increased starting from a temperature lower than a predetermined reference value that is lower than a color erasing temperature (a decolorization temperature) of the color erasable material and exceeds the predetermined reference value, and performs, after a passage of the predetermined period of time, maintenance control that is power supply control to maintain the temperature of the heat source at the target temperature. The sheet feeding section feeds a sheet to the heat source for a color erasing process after the passage of the predetermined period of time.

Embodiments will be described below with reference to the drawings.

(First Embodiment)

Figure 1:
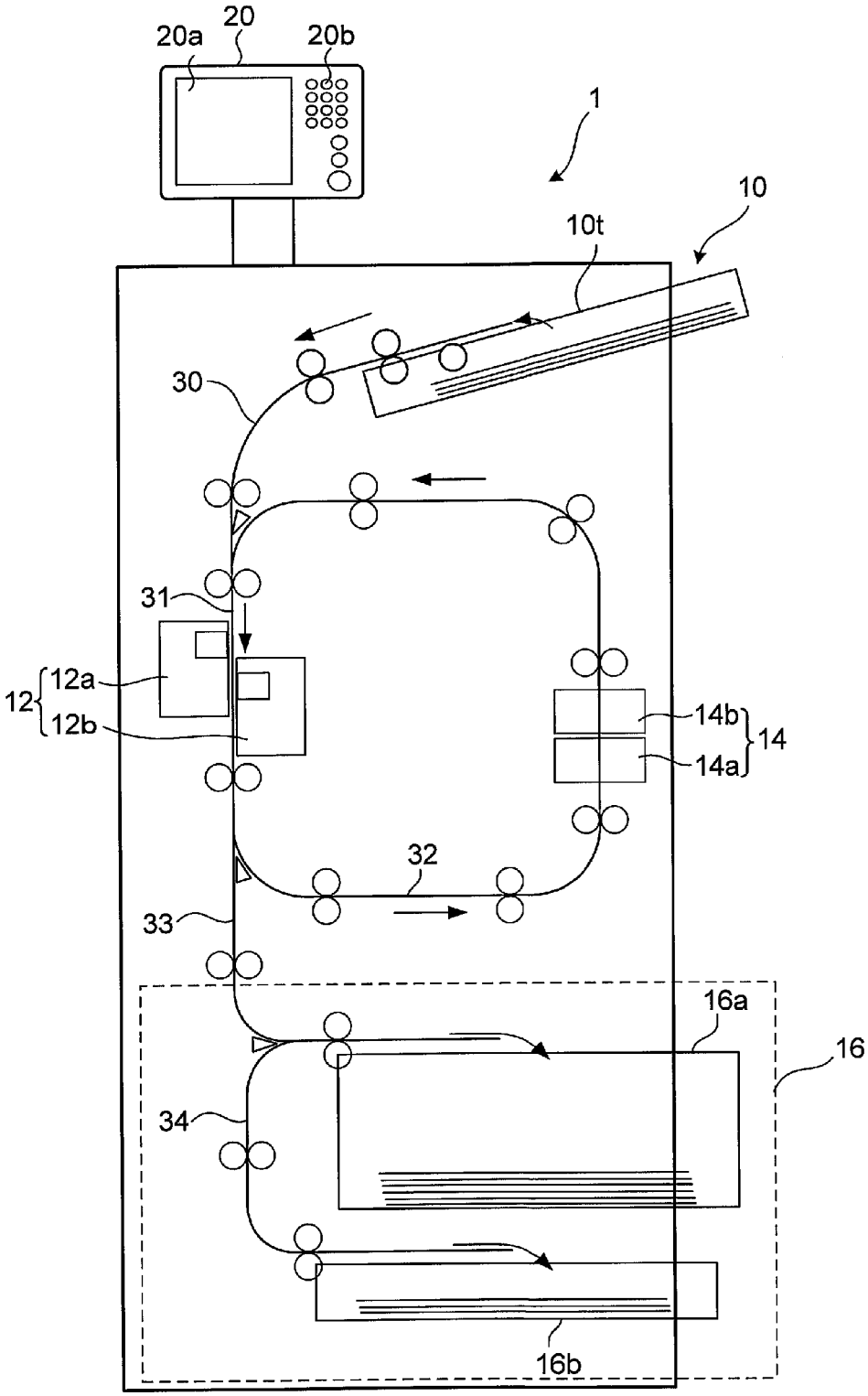
FIG. 1 is a diagram showing the device configuration of a color erasing device of an embodiment.
Figure 2:
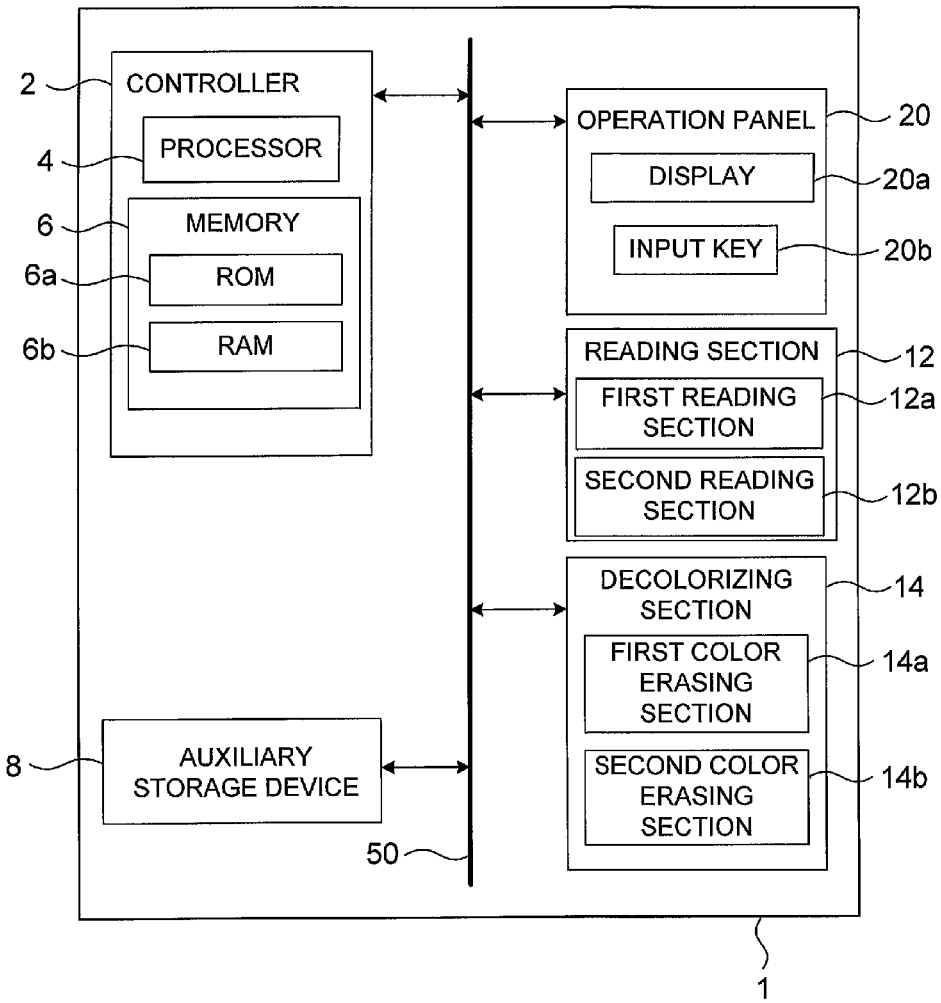
FIG. 2 is a diagram showing the configuration of the color erasing device of the embodiment.

FIG. 1 is a diagram showing the device configuration of a color erasing device (a decolorizing device) 1 of the present embodiment. FIG. 2 is a diagram showing the configuration of the color erasing device 1 of the present embodiment.

The color erasing device 1 includes a controller 2, an auxiliary storage device 8, a sheet feeding section 10, a reading section 12, a color erasing section 14, a sheet discharging section 16, an operation panel 20, and conveying paths 30 to 34. Components of the respective color erasing device 1 are connected together via a bus 50. Note that the sheet feeding section is formed by the controller 2, the sheet feeding section 10, the conveying paths, conveyance rollers, etc.

The controller 2 controls a color erasing process (a decolorizing process) in the color erasing device 1. The controller 2 is operated by a processor 4, a memory 6, and the like.

The processor 4 is a CPU (Central Processing Unit) or an MPU (Micro Processing Unit).

The memory 6 is a semiconductor memory, for example. The memory 6 includes a ROM (Read Only Memory) **6*a* for storing a control program for the processor 4 or the like, and a RAM (Random Access Memory) 6*b* for providing a temporal operating area for the processor 4. Further, the ROM 6*a* of the present embodiment stores some reference values to be described later, which are used to control a temperature of the color erasing section 14. Note that the memory 6** may also include another semiconductor memory other than the ROM or RAM, for example, a non-volatile memory.

Based on the control program stored in the ROM **6*a* (or in the auxiliary storage device 8), or the like, the controller 2 controls the sheet feeding section 10, the reading section 12, the color erasing section 14, the sheet discharging section 16, the conveyance rollers placed at the conveying paths 30 to 34, and the like to perform a color erasing process. Note that the controller 2 may include an ASIC (Application Specific Integrated Circuit) for implementing part or all of functions possessed by the color erasing device 1**.

The auxiliary storage device 8 is used, for example, to store image data read at the reading section 12. The auxiliary storage device 8 may be a magnetic storage device such as a hard disk drive, an optical storage device, a semiconductor storage device (flash memory or the like), or any combination of these storage devices, for example. Note that the auxiliary storage device 8 may be omitted since it is not an essential device for erasing color.

The sheet feeding section 10 feeds a sheet (a sheet of paper) to be subjected to the color erasing process. The sheet feeding section 10 includes a sheet feeding tray 10*t*. Loaded on the sheet feeding tray 10*t* are sheets which are subjects for the color erasing process. When performing the color erasing process, a sheet loaded on the sheet feeding tray 10*t* is picked up by a pick-up roller, and conveyed to the color erasing section 14 by the conveyance rollers. A sensor for detecting the presence or absence of a sheet in the tray may be disposed in the sheet feeding tray 10*t*.

The reading section 12 scans a sheet which is a subject for the color erasing process. The reading section 12 can also perform sheet scanning before and after the color erasing process. The scanning before the color erasing process is performed to store an image to be erased by the color erasing process. The storing of the image makes it possible to check the image in which color is erased even when the color of the image has been erased by error, for example. The scanning after the color erasing process is performed to determine, for example, whether or not the color of the image has been erased reliably by image processing. Note that the reading section 12 may be omitted since the reading process at the reading section 12 is not an essential process in the color erasing process itself.

Moreover, the reading section 12 includes a first reading section 12*a* and a second reading section 12*b* in order to scan both sides of a sheet. A CCD line sensor used to scan a document in a scanner, a copy machine, or the like, may be used for the first reading section 12*a* and the second reading section 12*b*. The first reading section 12*a* and the second reading section 12*b* are placed at both sides interposing the conveying path 31 therebetween in order to scan the different sides of the sheet, respectively.

Figure 3:
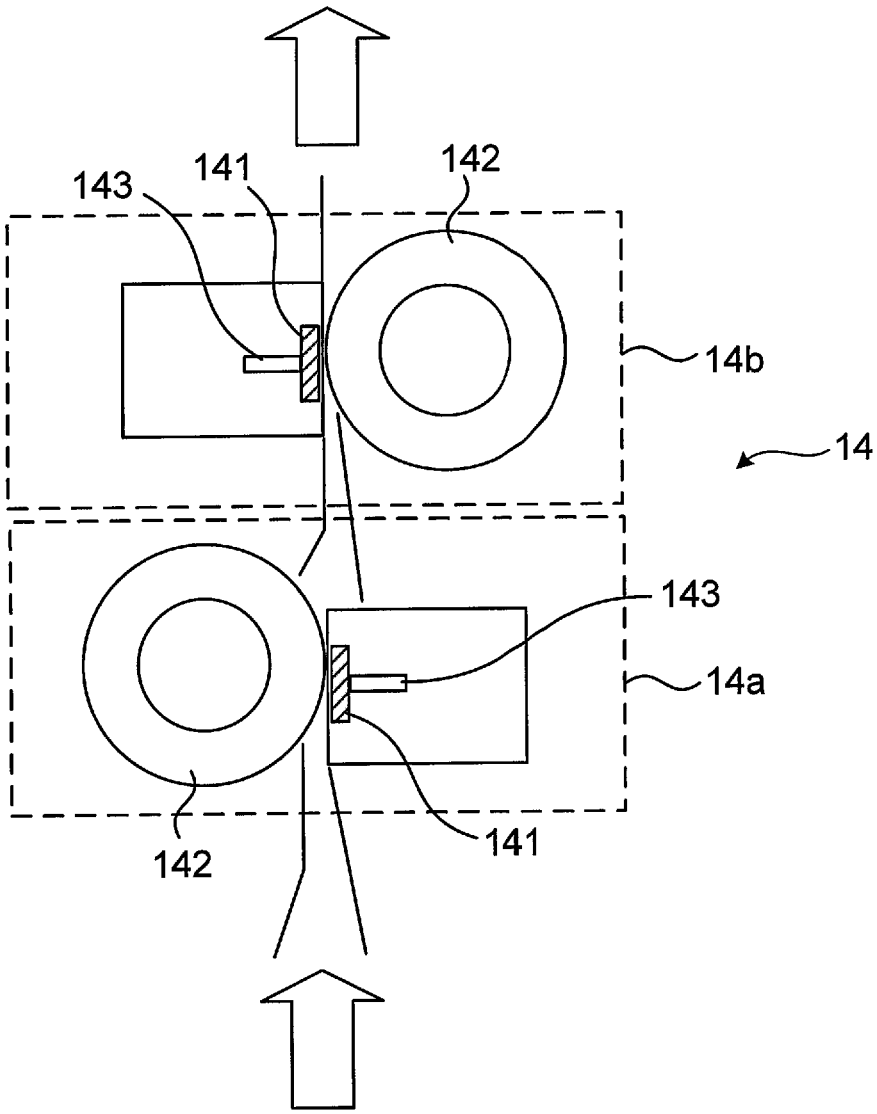
FIG. 3 is a diagram showing the device configuration of a color erasing section of the embodiment.

The color erasing section 14 performs the color erasing process by applying heat to the color erasable material forming an image on a sheet. FIG. 3 is a diagram showing the device configuration of the color erasing section 14. The color erasing section 14 includes a first color erasing section 14*a* and a second color erasing section 14*b*. The first color erasing section 14*a* and the second color erasing section 14*b* apply heat to different sides of the same sheet, respectively. Each of the first color erasing section 14*a* and the second color erasing section 14*b* includes a heater 141 serving as a heat source, a platen roller 142, and a temperature sensor 143.

The heater 141, serving as a heat source in the present embodiment, is a heater with a flat surface, and a film heater, for example, may be used as the heater 141. A width of the heater 141 in the axial direction of the platen roller 142 only needs to be greater than or equal to the width of a sheet passing through the color erasing section 14.

The platen roller 142 presses a sheet passing through the color erasing section 14 against a heated surface of the heater 141, thereby facilitating heat transfer to the sheet.

The temperature sensor 143 detects the temperature of the heater 141 for the purpose of temperature control of the heater 141. A thermistor, for example, is used as the temperature sensor 143.

Although the present embodiment is configured to include the first color erasing section 14*a* and the second color erasing section 14*b* in order to heat the both sides of a sheet, only one color erasing section may be provided if it is possible to erase the color of the image.

The sheet discharging section 16 accommodates sheets after being subjected to the color erasing process. The sheet discharging section 16 of the present embodiment includes a first discharged paper tray 16*a* and a second discharged paper tray 16*b*. As a result of image processing on an image read by the reading section 12 after the color erasing process, a sheet determined that the color erasing thereof has been done completely may be discharged to the first discharged paper tray 16*a*, and a sheet determined that the color erasing thereof is insufficient may be discharged to the second discharged paper tray 16*b*. Note however that such a usage is merely one example. If the first discharged paper tray 16*a* is filled up with sheets, sheets may be then discharged to the second discharged paper tray 16*b*. Alternatively, a destination of sheet discharge may be changed to other trays depending on a size of a sheet. Note that the two discharged paper trays are not always necessary since the discharged paper tray is not an essential element for the color erasing process itself. The configuration of the sheet discharging section 16 is not limited to a particular configuration as long as color erased sheets can be taken out from the color erasing device 1.

The operation panel 20 functions as display means for displaying various screens such as a setting screen used to perform the setting of the color erasing device 1 and input means used to make various inputs such as a setting operation. The operation panel 20 includes a display 20*a* and input keys 20*b*. The display 20*a* may be a touch panel capable of screen display and input. Alternatively, the input means may include a pointing device such as a mouse, a keyboard, or the like, in addition to the input keys 20*b*.

The conveying paths 30 to 34 are paths along which a sheet fed from the sheet feeding section 10 is conveyed. The most upstream side conveying path 30 is a path for allowing a sheet to be conveyed from the sheet feeding section 10 to the reading section 12 side. The conveying path 31 is a path for allowing a sheet to pass through the reading section 12. The conveying path 32 is a path for allowing a sheet to be conveyed to the color erasing section 14 and again to the conveying path 31. The conveying path 33 is a path for allowing a sheet to be conveyed to the sheet discharging section 16, and the conveying path 34 is a path for allowing a sheet to be conveyed to the second discharged paper tray 16*b*. In each of the conveying paths, the operations of the conveyance rollers, a flapper for switching one conveying path to another, and the like make it possible to convey a sheet to the appropriate one of the paths.

Note that the color erasing device 1 additionally may include a communication interface for establishing a wired or wireless connection with a computer, an image forming apparatus such as an MFP (Multi Function Peripheral), a storage medium such as a flash memory, or the like, directly or via a network.

A description will now be given of a sequential flow in the color erasing process from the paper feed to the paper discharge in the color erasing device 1 described above. First, a sheet is fed from the sheet feeding tray 10*t*, passes through the conveying path 30 and the conveying path 31, and then is scanned at the reading section 12. Next, the sheet passes through the conveying path 32 to be conveyed to the color erasing section 14. Both sides of the sheet are heated at the color erasing section 14 so that the color of the color erasable material on the sheet is erased. Next, the sheet passes through the conveying path 31 and the both sides of the sheet are scanned again at the reading section 12. Thereafter, the sheet passes through the conveying path 33 to be fed to the sheet discharging section 16. Then, the sheet is discharged to either the first discharged paper tray 16*a* or the second discharged paper tray 16*b*. Here, it may be configured as described above so that the reading section 12 reads the sheet after being subjected to the color erasing process, the controller 2 determines whether or not the color erasing thereof has been completely done, and a sheet determined that the color erasing thereof is insufficient is discharged to the second discharged paper tray 16*b*.

Figure 4:
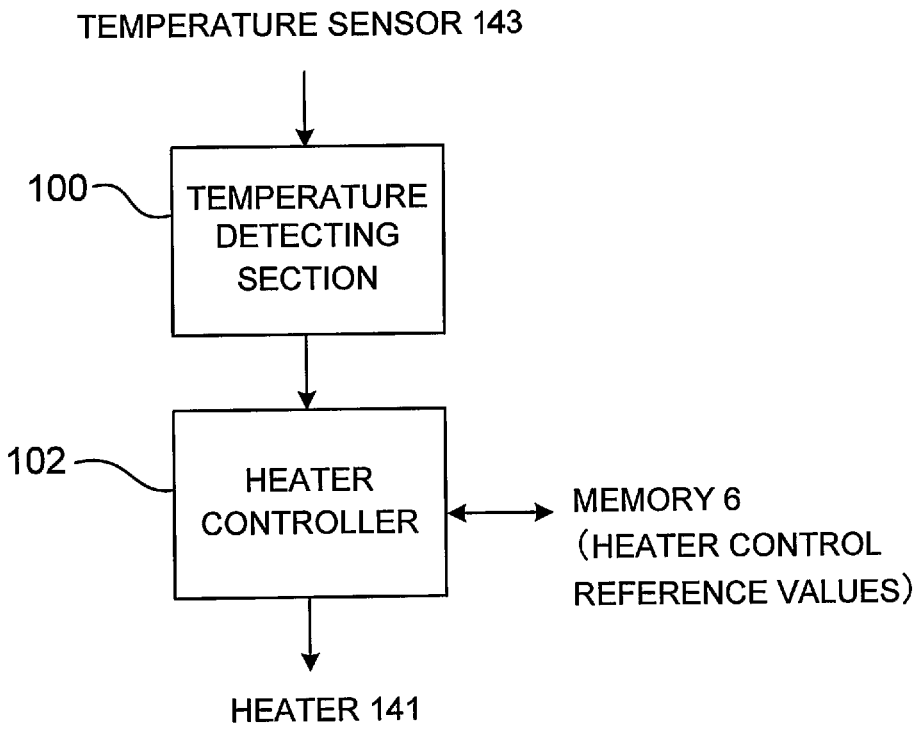
FIG. 4 is a functional block diagram showing functions regarding control of the color erasing section in the embodiment.

Next, a description will be given of a method for controlling the color erasing section 14 in the color erasing process in the color erasing device 1 of the present embodiment. FIG. 4 is a functional block diagram showing functions regarding the control of the color erasing section 14 in the present embodiment. The color erasing device 1 includes a temperature detecting section 100 and a heater controller 102.

The temperature detecting section 100 detects a temperature of the heater 141 by the temperature sensor 143.

The heater controller 102 controls the heater 141 on the basis of the temperature of the heater 141 detected by the temperature detecting section 100 (hereinafter referred to also as a detected temperature). Specifically, based on some heater control reference values stored in the memory 6 or the like, and the detected temperature of the heater 141, the heater controller 102 controls power supply to the heater 141 and thereby turns ON and OFF the heater 141. The heater control reference values include: a controlled temperature lower limit T1, which is a first temperature; a controlled temperature upper limit T2, which is a second temperature; a controlled temperature limit value T3; and a heat source temporal stop value T4, which is a predetermined reference value.

The controlled temperature lower limit T1 is a reference value at which the heater controller 102 turns ON the heater 141 if the detected temperature of the heater 141 in an OFF state is decreased to T1 from a temperature higher than T1.

The controlled temperature upper limit T2 is a reference value at which the heater controller 102 turns OFF the heater 141 if the detected temperature of the heater 141 in an ON state is increased to T2.

The controlled temperature lower limit T1 and the controlled temperature upper limit T2 are set on the basis of a temperature to be maintained (hereinafter referred to also as a target temperature) as the temperature of the heater 141 during the color erasing process. For example, if the heater 141 is to be maintained at 150° C. (i.e., the target temperature is 150° C.), the temperature of the heater 141 can be maintained approximately at 150° C. by setting the controlled temperature lower limit T1 to 149° C. and the controlled temperature upper limit T2 to 150° C. Note that the target temperature is typically greater than or equal to a color erasing temperature at which the color of a color erasable material is erased, and the color erasing temperature is higher than a fixing temperature when an image is formed with the color erasable material.

The controlled temperature limit value T3 corresponds to a temperature at which the temperature of the heater 141 is determined to be abnormally high. If the detected temperature is reached to the controlled temperature limit value T3, the heater controller 102 turns OFF the heater 141 to discontinue the color erasing process in order to prevent the heater 141 or the like from being damaged.

The heat source temporal stop value T4 is a reference value at which the heater controller 102 temporarily turns OFF the heater 141 if the heater 141 is turned ON in a state where the detected temperature of the heater 141 is lower than T4 and the temperature of the heater 141 is thereby being increased for the purpose of warming-up to raise the temperature of the heater 141 up to the target temperature. The heat source temporal stop value T4 is set to be lower than the controlled temperature lower limit T1. Note that the heater controller 102 temporarily turns OFF the heater 141 if the detected temperature of the heater 141 is increased to the heat source temporal stop value T4 from a temperature below T4. Further, the heat source temporal stop value T4 corresponds to a temperature lower than the color erasing temperature at which the color of the color erasable material is erased.

These heater control reference values are preferably stored in a non-volatile memory which retains stored information even after the power is turned off. Examples of the non-volatile memory may include the ROM 6*a* and another readable and writable non-volatile memory. Moreover, if the color erasing device 1 includes the auxiliary storage device 8, the heater control reference values may be stored in the auxiliary storage device 8.

Figure 5:
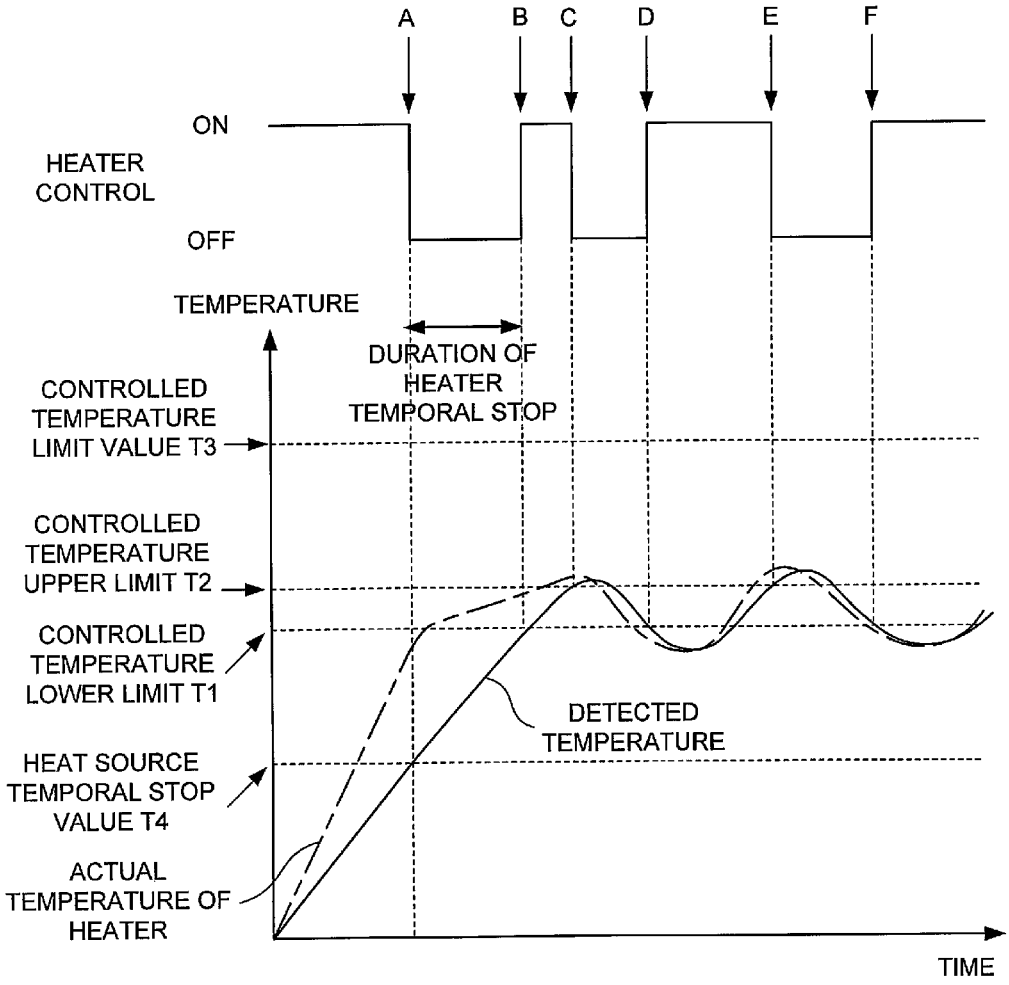
FIG. 5 is a graph showing the relationship between temperatures detected by a temperature sensor and actual temperatures of a heater, and timings for heater control based on the detected temperatures.

Now referring to FIG. 5, a description will be given of a sequential flow of the heater control performed by the heater controller 102 based on the heater control reference values. FIG. 5 is a graph showing the relationship between detected temperatures of the heater 141 detected by the temperature sensor and actual temperatures of the heater 141, and timings for turning ON and OFF the heater 141 based on the detected temperatures. The graph on the lower side of the figure represents time on the horizontal axis thereof and temperatures on the vertical axis thereof. The heater control shows ON and OFF of the heater 141 with respect to the time on the horizontal axis. In the graph of FIG. 5, a curve shown by a solid line represents detected temperatures detected by the temperature sensor 143, and a curve shown by a dashed-dotted line represents actual temperatures of the heater 141.

First, in order to start the color erasing process in the color erasing device 1, the heater controller 102 turns ON the heater 141 for the purpose of the warming-up to allow the heater 141 to increase the temperature thereof up to the target temperature at which the color erasing process can be performed. Once the heater 141 is turned ON and current application to the heater is thereby started, the actual temperature of the heater increases with a higher increasing rate (i.e., with a larger temperature change per unit time) than the detected temperature while both of the detected temperature and the actual temperature of the heater are increased. The reason why a discrepancy occurs as described above between the detected temperature detected by the temperature sensor 143 and the actual temperature of the heater 141 at an initial stage after the current application is started is that the temperature sensor 143 cannot follow the actual temperature change of the heater 141 for the reason, for example, that the heat capacity of the temperature sensor 143 is greater than that of the heater 141, or the like.

Thereafter, when the temperature detected by the temperature sensor 143 reaches the heat source temporal stop value T4, the heater controller 102 turns OFF the heater 141 at this timing A (timing shown by an arrow A in FIG. 5). After the heater 141 is turned OFF, the heater controller 102 keeps the heater 141 in an OFF state during a predetermined period of time.

The reason why the heater 141 is kept in an OFF state during the predetermined period of time when the detected temperature reaches the heat source temporal stop value T4 is that the turning OFF of the heater 141 allows the actual temperature of the heater 141 to increase with a slow increasing rate and the detected temperature thus catches up with the actual temperature, thereby reducing a discrepancy between the detected temperature and the actual temperature of the heater 141. If a discrepancy between the detected temperature and the actual temperature is reduced, the temperature sensor 143 can now follow the actual temperature change of the heater 141, thereby enabling precise control of the heater 141. Moreover, if such a discrepancy is small, it is also possible to prevent the actual temperature of the heater 141 from exceeding the controlled temperature limit value T3.

If the heater 141 is kept in an OFF state during even a small amount of time after the detected temperature is increased up to the heat source temporal stop value T4 from a value below the heat source temporal stop value T4, it is possible to reduce a discrepancy between the detected temperature and the actual temperature of the heater 141. Thus, while the "predetermined period of time" during which the heater is kept in an OFF state is not limited to any particular period of time, it is preferably a period of time until the detected temperature of the heater 141 catches up with the actual temperature of the heater 141 since the start of the power supply to the heater 141. Since an amount of time required for the catching-up varies depending on various conditions such as a type of the heater and an electric energy amount to be supplied to the heater, the predetermined period of time may be determined by measuring an amount of time required for the catching-up using the actual device configuration and under the actual processing conditions. Moreover, whether or not the detected temperature is caught up with and can follow the actual temperature can be determined from a reduction in the increasing rate of the detected temperature (the amount of temperature change per unit time). In other words, if a temperature increase per unit time is reduced while the heater 141 is in an OFF state, it can be said that an increase in the actual temperature of the heater 141 is stopped or reduced, thereby allowing the detected temperature to approach the actual temperature, and the increasing rate of the detected temperature is also being reduced. Thus, the predetermined period of time maybe defined as a period of time until the increasing rate of the detected temperature starts to decrease since the achievement of the heat source temporal stop value T4.

At timing B after a passage of the predetermined period of time since the heater is turned OFF, the heater controller 102 turns ON the heater 141. Then, the heater controller 102 turns OFF the heater 141 at timing C where the detected temperature reaches the controlled temperature upper limit T2. At timing D where the detected temperature declines to the controlled temperature lower limit T1, the heater controller 102 turns ON the heater 141 again. Subsequently, the heater controller 102 repeats control for turning OFF the heater 141 when the detected temperature is increased up to the controlled temperature upper limit T2 from a temperature below T2 and control for turning ON the heater 141 when the detected temperature is declined to the controlled temperature lower limit T1 from a temperature above T1. In this manner, the temperature of the heater 141 can be maintained at the target temperature on average. After timing C, the power supply control such that the heater 141 is turned OFF when the detected temperature is increased up to the controlled temperature upper limit T2 and the heater 141 is turned ON when the detected temperature is declined to the controlled temperature lower limit T1 corresponds to control for maintaining the heater 141 at the target temperature.

Those described above are the functions of the color erasing device 1 of the present embodiment regarding the color erasing process. According to the above-described functions, it is possible to suppress a discrepancy between the detected temperature detected by the temperature sensor 143 and the actual temperature of the heater 141 as described above. In particular, since the discrepancy can be eliminated at an early stage after the turning ON of the heater 141, it becomes possible to perform the color erasing process at the target temperature at the early stage and the warming-up period of time can be thus shortened.

Figure 6:
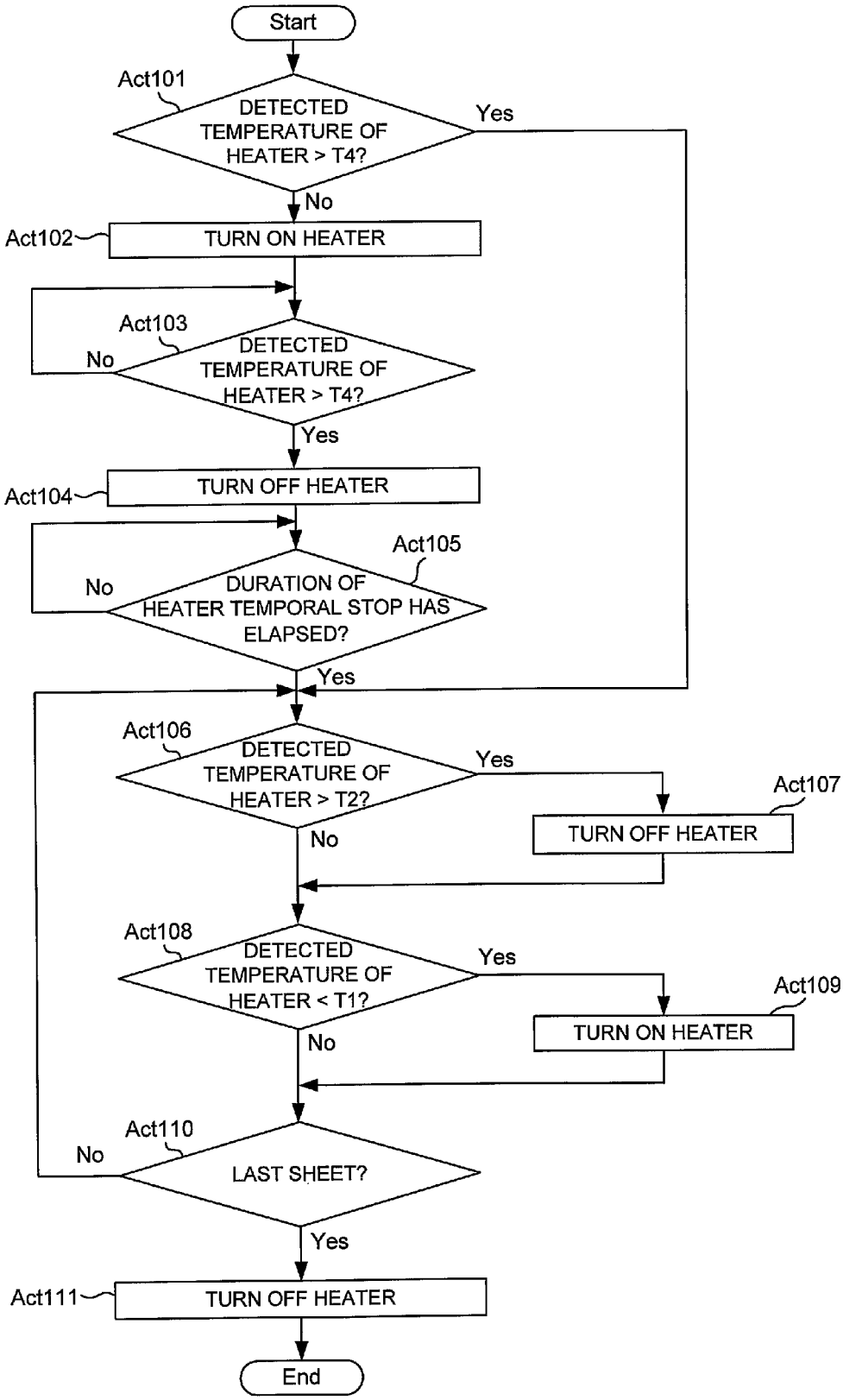
FIG. 6 is a flow chart for illustrating a flow of temperature control processes of the color erasing section.

A flow of temperature control processes of the color erasing section 14 in the color erasing device 1 of the present embodiment will now be described. FIG. 6 is a flow chart for illustrating the flow of the temperature control processes of the color erasing section 14.

First, when the color erasing device 1 is instructed to start the color erasing process by means of an input from the operation panel 20 or the like, the heater controller 102 determines whether or not the detected temperature of the heater 141 detected by the temperature detecting section 100 is higher than the heat source temporal stop value T4 (Act101).

If it is determined that the detected temperature of the heater is lower than or equal to the heat source temporal stop value T4 (No in Act101), the heater controller 102 turns ON the heater 141 (Act102).

After the heater 141 is turned ON, the heater controller 102 determines whether or not the detected temperature of the heater 141 is higher than the heat source temporal stop value T4 (Act103).

If the detected temperature of the heater is lower than or equal to the heat source temporal stop value T4 (No in Act103), the heater controller 102 repeats Act103.

If it is determined that the detected temperature of the heater is higher than the heat source temporal stop value T4 (Yes in Act103), the heater controller 102 turns OFF the heater 141 (Act104).

Next, the heater controller 102 determines whether or not the predetermined period of time (amount of time during which the heater is temporarily stopped) has elapsed since the turning OFF of the heater 141 in Act104 (Act105).

If the predetermined period of time has not elapsed (No in Act105), the heater controller 102 repeats Act105.

If it is determined that the predetermined period of time has elapsed (Yes in Act105), the heater controller 102 determines whether or not the detected temperature of the heater 141 is higher than the controlled temperature upper limit T2 (Act106). Also if it is determined that the detected temperature of the heater 141 is higher than the heat source temporal stop value T4 in Act101 (Yes in Act 101), the process proceeds to Act106.

If the detected temperature of the heater 141 is higher than the controlled temperature upper limit T2 (Yes in Act106), the heater controller 102 turns OFF the heater 141 (Act107). Note that if the process first proceeds to Act106 immediately after the start of Act101, the heater 141 is already in an OFF state and therefore the OFF state is maintained.

If the detected temperature of the heater 141 is lower than or equal to the controlled temperature upper limit T2 (No in Act106), or after the heater 141 is turned OFF in Act107, the heater controller 102 determines whether or not the detected temperature of the heater 141 is lower than the controlled temperature lower limit T1 (Act108).

If it is determined that the detected temperature of the heater 141 is lower than the controlled temperature lower limit T1 (Yes in Act108), the heater controller 102 turns ON the heater 141 (Act109).

If the detected temperature of the heater 141 is greater than or equal to the controlled temperature lower limit T1 (No in Act108), or after the heater 141 is turned ON in Act109, the controller 2 determines whether or not all of the color erasing processes have been completed, i.e., whether or not the color erasing process has been completed on the last one of the sheets which are the subjects for the color erasing process (Act110). Specifically, the controller 2 makes the determination by detecting whether or not any sheet is left in the sheet feeding tray 10*t* using, for example, a sensor disposed in the sheet feeding tray 10*t*.

If it is determined that the sheet is the last one and the color erasing process has been completed for all of the sheets (Yes in Act110), the heater controller 102 turns OFF the heater 141 (Act111) and ends the color erasing process. If it is determined that any sheet is left (No in Act110), on the other hand, the process returns to Act106.

This is the flow of the temperature control processes of the color erasing section 14 in the color erasing device 1 of the present embodiment. Note that the processes up to Act105 correspond to the warming-up control in the present embodiment, and those following Act106 correspond to the temperature maintenance control.

Note that the color erasing device 1 of the present embodiment includes the two color erasing sections (the first color erasing section 14*a* and the second color erasing section 14*b*). Thus, the controller 2 may implement the functions shown in FIG. 4 for each of the heaters 141, and may control each heater 141 according to the process flow of FIG. 6.

Moreover, although the heater 141 is described as a heater of a sheet shape in the present embodiment, the heater 141 is not limited thereto. A heater having another configuration such as a heating roller used in a fixing device may be used.

Moreover, the device configuration of the color erasing device 1 is merely one example, and the configuration excluding the color erasing section 14, which erases the color of the color erasable material on a sheet by allowing a sheet to pass therethrough and heat to be applied to the sheet, is not limited to that described in the present embodiment.

Further, while a single heat source temporal stop value (T4) is set and the power supply to the heater 141 is stopped only once in the present embodiment, a plurality of heat source temporal stop values may set depending on the characteristics of the heater 141 and the temperature sensor 143 and the heater controller 102 may stop the power supply to the heater 141 a plurality of times before the temperature maintenance control is started.

(Second Embodiment)

The color erasing device 1 of the present embodiment is characterized in that the heater control reference values can be set by a user. The present embodiment will now be described with reference to a drawing, and the description overlapping with the previously-described embodiment will be omitted. Also, the elements identical to those in the previously-described embodiment will be denoted by the same reference numerals.

Figure 7:
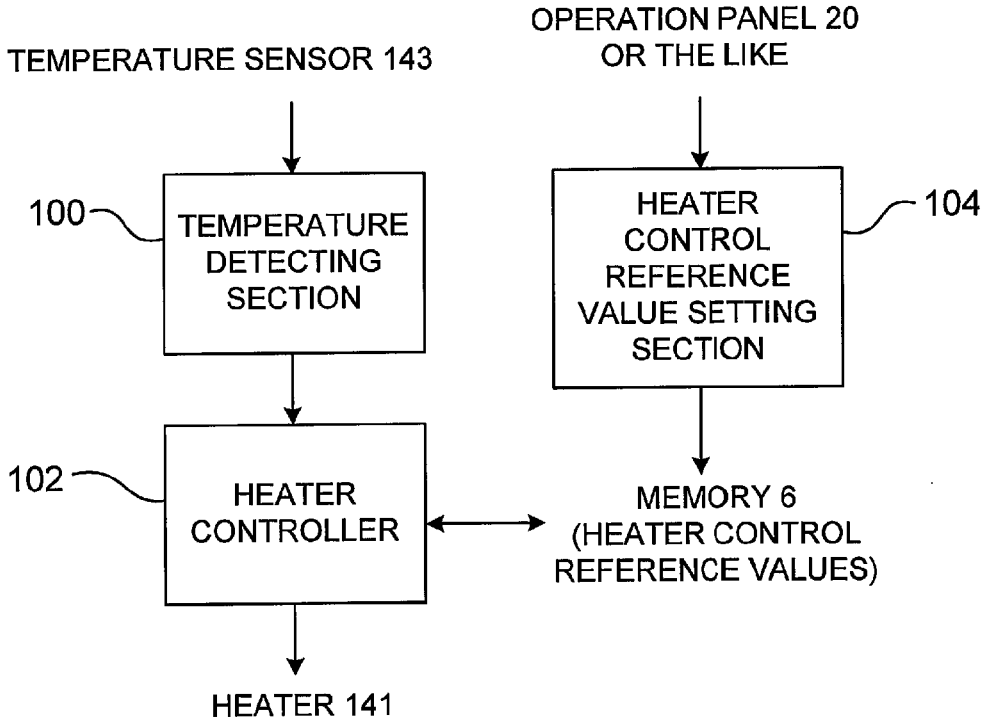
FIG. 7 is a functional block diagram showing functions of a color erasing device of another embodiment.

FIG. 7 is a functional block diagram showing functions of the color erasing device 1 of the present embodiment. The color erasing device 1 of the present embodiment includes: the temperature detecting section 100, the heater controller 102, and a heater control reference value setting section 104 as functional blocks regarding the control of the heater 141. The description of the temperature detecting section 100 and the heater controller 102 will be omitted since they are similar to those in the first embodiment.

The heater control reference value setting section 104 sets the heater control reference values upon receipt of an input to set the heater control reference values. Specifically, when an input to instruct the display of a screen for setting the heater control reference values is made by the operation panel 20 or the like, the controller 2 allows the screen for setting the heater control reference values to be displayed on the display 20*a*. Then, if the heater control reference values are inputted on the setting screen, the heater control reference value setting section 104 stores the inputted heater control reference values in a predetermined storage area. The heater control reference values includes the controlled temperature lower limit T1, the controlled temperature upper limit T2, the controlled temperature limit value T3, and the heat source temporal stop value T4, as described above. Any one of these values may be made settable, or some or all of these values may be made settable.

In the present embodiment, the predetermined storage area where the inputted heater control reference values are stored needs to be included in a readable and writable storage device. Further, the predetermined storage area is preferably a non-volatile storage device. The storage device in which the inputted heater control reference values are stored may be included as a part of the memory 6. Alternatively, if the auxiliary storage device 8 is provided, the auxiliary storage device 8 may be used as that storage device.

Then, the heater controller 102 controls the heater 141 on the basis of the reference values set by the heater control reference value setting section 104. Since the specific method for controlling the heater 141 is similar to the method described in the first embodiment, the description thereof will be omitted.

According to the present embodiment, a user, an operator to conduct maintenance work, or the like can set the heater control reference values for controlling the heater 141 to desired values. Accordingly, reference values optimum for the color erasing process can be set in accordance with the environment when used and an individual variability such as in the heater 141 of the color erasing device 1.

Note that the controller 2 may perform a control so that temperature ranges over which the heater control reference values can be set respectively are displayed on the screen for setting the heater control reference values. By displaying the settable temperature ranges, it is possible to avoid the setting of an inappropriate temperature as a heater control reference value. Moreover, the setting screen may be displayed on the display 20*a* or the like by a display controller implemented by the controller 2.

(Third Embodiment)

The color erasing device 1 of the present embodiment is characterized in that a temperature at which the heater 141 is maintained during the color erasing process is changed to another. The present embodiment will be described below specifically.

Although the functional blocks of the color erasing device 1 according to the present embodiment are similar to those of FIG. 4, the heater controller 102 changes a temperature of the heater 141 during the color erasing process in accordance with an implementation status of the color erasing process. Specifically, the heater controller 102 of the present embodiment controls the heater 141 on the basis of first heater control reference values during the normal operation, and the heater controller 102 controls the heater 141 on the basis of the second heater control reference values if the implementation status of the color erasing process satisfies a predetermined condition.

The predetermined condition being satisfied refers to a state where temperatures in and around the color erasing section 14 are increased as a result of the color erasing processes continuously performed by the color erasing section 14 of the color erasing device 1 and the color erasing process can be sufficiently performed by utilizing such surrounding heat even if the temperature of the heater 141 is reduced. If such a predetermined condition is satisfied, the heater controller 102 then performs a process of lowering the temperature of the heater 141 to a temperature lower than that during the normal operation.

Specific examples of the predetermined condition may include a predetermined amount of time having been elapsed since the start of the color erasing process currently being performed, and the number of sheets already subjected to the color erasing process having reached a predetermined number in the color erasing process currently being performed. Each condition relates to how long a color erasing process is being continued. Therefore, a predetermined amount of time or a predetermined number may be set as the predetermined condition so that temperatures in and around the color erasing section 14 can be sufficiently increased during such a period.

It is only necessary that at least the controlled temperature lower limits and the controlled temperature upper limits, which are the target temperatures of the heater 141 during the color erasing process, are respectively set as the first heater control reference values and the second heater control reference values. For example, a controlled temperature upper limit T21 and a controlled temperature lower limit T11 are set as the first heater control reference values. A controlled temperature upper limit T22 lower than T21 and a controlled temperature lower limit T12 lower than T11 are set as the second heater control reference values. Specifically, the controlled temperature upper limit T21 can be set to 150° C., the controlled temperature lower limit T11 to 149° C., the controlled temperature upper limit T22 to 145° C., and the controlled temperature lower limit T12 to 144° C., for example. These heater control reference values are stored in a non-volatile memory in the memory 6 (or auxiliary storage device 8) as with the first embodiment.

As to the heat source temporal stop value T4 and the controlled temperature limit value T3, two different values or a common value may be set as the first heater control reference values and the second heater control reference values. As to the controlled temperature limit value T3, however, since the limit value is more easily reached due to an increase in the temperature around the color erasing section 14, it is preferable that a controlled temperature limit value lower than the limit value during the normal operation be set as a controlled temperature limit value in a case where the predetermined condition is satisfied.

Moreover, as to the heater control reference values in the present embodiment, a user may set desired values as with the second embodiment. The method for setting desired values is as described in the second embodiment.

According to the above-described embodiments, in a case where the temperatures in and around the color erasing section 14 are increased due to continuously-performed color erasing processes in the color erasing device 1, it is possible to reduce the target temperature of the heater 141 during the color erasing process. Such a temperature reduction of the heater 141 can prevent a sheet from being heated excessively due to heat retained in the heater 141 and the surrounding members thereof. If a sheet is excessively heated, a resin component contained in the color erasable material is melted and attached to a surface of the heater 141, the platen roller 142, or the like, thereby causing a jam.

Moreover, since the color erasing process can be performed utilizing the temperature around the heater 141, an electric power used can be reduced.

While the methods for controlling the temperature of the color erasing section 14 described in the first to third embodiments above have been described as the control methods in the device dedicated for the color erasing process, these methods are not limited thereto. For example, the temperature control methods shown as the embodiments can be applied also to a case where an image forming apparatus such as an MFP includes a color erasing section or a case where a fixing device of an image forming apparatus is utilized as a color erasing section.

As described above in detail, the embodiments can provide a method for color erasing process with which a discrepancy between a detected temperature of the heat source for the color erasing process and an actual temperature thereof is small and which can therefore accurately control the temperature of the heat source in the color erasing section, and can provide a color erasing device for performing the color erasing process on the basis of the method.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A method for color erasing process, comprising:

supplying a power to a heat source configured to heat a sheet having an image formed thereon using a color erasable material to be color erased by heat;

causing the heat source to generate heat by supplying the power;

stopping the power supply to the heat source for a predetermined period of time if the temperature of the heat source exceeds a predetermined reference value that is lower than a color erasing temperature of the color erasable material; and performing, after a passage of the predetermined period of time, maintenance control that is power supply control to maintain the temperature of the heat source at a target temperature set as a temperature used during the color erasing process.

2. The method for color erasing process according to claim 1, wherein whether or not the temperature of the heat source is lower than the predetermined reference value is determined before starting the power supply to the heat source, and if the temperature of the heat source is lower than the predetermined reference value, the power supply to the heat source is started.

3. The method for color erasing process according to claim 2, wherein if the temperature of the heat source before starting the power supply to the heat source is greater than or equal to the predetermined reference value, the maintenance control to maintain the temperature of the heat source at the target temperature is performed without stopping the power supply to the heat source for the predetermined period of time.

4. The method for color erasing process according to claim 1, wherein the maintenance control to maintain the temperature of the heat source at the target temperature is control such that a power is supplied to the heat source if the temperature of the heat source is decreased below a first temperature that is higher than the predetermined reference value, and the power supply to the heat source is stopped if the temperature of the heat source exceeds a second temperature that is higher than the first temperature.

5. The method for color erasing process according to claim 1, wherein the predetermined period of time corresponds to a period between a point in time when the power supply is stopped and a point in time when an increasing rate of the temperature of the heat source starts to decrease.

6. The method for color erasing process according to claim 1, wherein the heat source is a heater of a film shape having a heat capacity smaller than that of an element configured to detect the temperature of the heat source.

7. The method for color erasing process according to claim 4, wherein a setting screen configured to set at least any one temperature of the first temperature, the second temperature, and the predetermined reference value is displayed, and the at least any one temperature can be set by an input to the setting screen.

8. The method for color erasing process according to claim 4, wherein if an implementation status of the color erasing process satisfies a predetermined condition, both the first temperature and the second temperature are then lowered.

9. The method for color erasing process according to claim 8, wherein if an amount of time during which the color erasing process is being continuously performed exceeds a predetermined amount of time, both the first temperature and the second temperature are then lowered.

10. The method for color erasing process according to claim 8, wherein if a number of sheets continuously subjected to the color erasing process exceeds a predetermined number, both the first temperature and the second temperature are then lowered.

11. A color erasing device comprising:

a heat source configured to heat a sheet having an image formed thereon using a color erasable material to be color erased by heat;

a temperature detecting section configured to detect a temperature of the heat source;

a heat source controller configured to supply a power to the heat source, to stop the power supply to the heat source for a predetermined period of time if the temperature of the heat source detected by the temperature detecting section exceeds a predetermined reference value that is lower than a color erasing temperature of the color erasable material, and to perform, after a passage of the predetermined period of time, maintenance control that is power supply control to maintain the temperature of the heat source at a target temperature set as a temperature used during a color erasing process; and a sheet feeding section configured to feed a sheet to the heat source for a color erring process after the passage of the predetermined period of time.

12. The color erasing device according to clan 11, wherein the heat source controller determines whether or not the temperature of the heat source is lower than the predetermined reference value before starting the power supply to the heat source, and if the temperature of the heat source is lower than the predetermined reference value, the power supply to the heat source is started.

13. The color erasing device according to claim 12, wherein the heat source controller performs the maintenance control to maintain the temperature of the heat source at the target temperature without stopping the power supply to the heat source for the predetermined period of time if the temperature of the heat source before starting the power supply to the heat source is greater than or equal to the predetermined reference value.

14. The color erasing device according to claim 11, wherein the maintenance control to maintain the temperature of the heat source at the target temperature is control such that a power is supplied to the heat source if the temperature of the heat source is decreased below a first temperature that is higher than the predetermined reference value, and the power supply to the heat source is stopped if the temperature of the heat source exceeds a second temperature that is higher than the first temperature.

15. The color erasing device according to claim 11, wherein the predetermined period of time corresponds to a period between a point in time when the power supply is stopped and a point in time when an increasing rate of the temperature of the heat source starts to decrease.

16. The color erasing device according to claim 11, wherein the heat source is a heater of a film shape having a heat capacity smaller than that of an element configured to detect the temperature of the heat source.

17. The color erasing device according to claim 14, further comprising:

a display controller configured to allow display of a setting screen to set at least any one temperature of the first temperature, the second temperature, and the predetermined reference value; and a heat source control reference value setting section configured to set the at least any one temperature on the basis of an input to the setting screen.

18. The color erasing device according to claim 14, wherein if an implementation status of the color erasing process satisfies a predetermined condition, the heat source controller then lowers both the first temperature and the second temperature.

19. The color erasing device according to claim 18, wherein if an amount of time during which the color erasing process is being continuously performed exceeds a predetermined amount of time, the heat source controller then lowers both the first temperature and the second temperature.

20. The color erasing device according to claim 18, wherein if a number of sheets continuously subjected to the color erasing process exceeds a predetermined number, the heat source controller then lowers both the first temperature and the second temperature.

* * * * *